US009031266B2

(12) United States Patent
Dehe et al.

(10) Patent No.: US 9,031,266 B2
(45) Date of Patent: May 12, 2015

(54) ELECTROSTATIC LOUDSPEAKER WITH MEMBRANE PERFORMING OUT-OF-PLANE DISPLACEMENT

(75) Inventors: Alfons Dehe, Reutlingen (DE); Mohsin Nawaz, Unterhaching (DE); Christoph Glacer, Munich (DE)

(73) Assignee: Infineon Technologies AG, Neubiberg (DE)

( * ) Notice: Subject to any disclaimer, the term of this patent is extended or adjusted under 35 U.S.C. 154(b) by 332 days.

(21) Appl. No.: 13/270,613

(22) Filed: Oct. 11, 2011

(65) Prior Publication Data

US 2013/0089224 A1 Apr. 11, 2013

(51) Int. Cl.

| | |
|---|---|
| ***H04R 25/00*** | (2006.01) |
| ***H04R 3/00*** | (2006.01) |
| ***H04R 1/00*** | (2006.01) |
| ***H04R 9/06*** | (2006.01) |
| ***H04R 11/02*** | (2006.01) |
| ***H04R 19/02*** | (2006.01) |
| ***H04R 19/01*** | (2006.01) |
| *H04R 7/04* | (2006.01) |

(52) U.S. Cl.

CPC ..... *H04R 19/02* (2013.01); *H04R 19/013* (2013.01); *H04R 7/04* (2013.01)

(58) Field of Classification Search

CPC ..... H04R 19/04; H04R 3/00; H04R 19/016; H04R 19/02; H04R 19/013; H04R 19/005; H04R 19/01; H04R 19/00; H04R 9/025; H04R 9/06

USPC ..... 381/191, 398, 174, 113, 116

See application file for complete search history.

(56) References Cited

U.S. PATENT DOCUMENTS

| | | | | |
|---|---|---|---|---|
| 1,948,637 | A * | 2/1934 | Vogt | 381/191 |
| 2,140,859 | A * | 12/1938 | Panzerbieter et al. | 381/180 |
| RE28,420 | E * | 5/1975 | Murphy | 381/191 |
| 4,317,965 | A * | 3/1982 | Toyoda | 381/431 |

(Continued)

FOREIGN PATENT DOCUMENTS

| | | |
|---|---|---|
| DE | 102005056759 | 5/2007 |
| WO | 2006083482 | 8/2006 |
| WO | 2010038229 | 4/2010 |

OTHER PUBLICATIONS

Neumann, Jr., et al., "CMOS-MEMS Membrane for Audio-Frequency Acoustic Actuation".

*Primary Examiner* — Matthew Eason
*Assistant Examiner* — Sean H Nguyen
(74) *Attorney, Agent, or Firm* — Banner & Witcoff, Ltd.

(57) ABSTRACT

An electrostatic loudspeaker comprises a membrane structure and an electrode structure. The membrane structure comprises a central membrane portion and a circumferential membrane portion. The electrode structure is configured to electrostatically interact with the membrane structure for causing a movement of the membrane structure along an axis of movement. The electrode structure comprises a circumferential electrode portion and an opening, the circumferential electrode portion being substantially aligned to the circumferential membrane portion and the opening being substantially aligned to the central membrane portion with respect to a direction parallel to the axis of movement. In an end position of the movement of the membrane structure, the central membrane portion is configured to extend at least partially through the opening. A method for operating an electrostatic loudspeaker and a method for manufacturing an electrostatic loudspeaker are also described.

25 Claims, 12 Drawing Sheets

(56) References Cited

U.S. PATENT DOCUMENTS

| | | | | |
|---|---|---|---|---|
| 4,413,161 | A * | 11/1983 | Matsumoto et al. | 381/408 |
| 5,155,653 | A * | 10/1992 | Kremidas | 361/283.4 |
| 5,490,220 | A * | 2/1996 | Loeppert | 381/355 |
| 5,870,482 | A * | 2/1999 | Loeppert et al. | 381/174 |
| 6,389,148 | B1 * | 5/2002 | Yoo et al. | 381/417 |
| 6,552,469 | B1 * | 4/2003 | Pederson et al. | 310/309 |
| 6,744,896 | B2 * | 6/2004 | Tanabe et al. | 381/191 |
| 7,132,307 | B2 * | 11/2006 | Wang et al. | 438/53 |
| 7,218,749 | B1 * | 5/2007 | Noponen et al. | 381/431 |
| 7,502,482 | B2 * | 3/2009 | Dehe et al. | 381/175 |
| 7,675,217 | B2 | 3/2010 | Delevoye et al. | |
| 7,853,027 | B2 * | 12/2010 | Yamaoka et al. | 381/174 |
| 7,902,615 | B2 | 3/2011 | Schlosser et al. | |
| 8,059,842 | B2 * | 11/2011 | Suzuki et al. | 381/174 |
| 8,150,091 | B2 * | 4/2012 | Eaton et al. | 381/386 |
| 8,410,659 | B2 * | 4/2013 | Chang | 310/309 |
| 2006/0215858 | A1 * | 9/2006 | Pedersen | 381/191 |
| 2007/0003082 | A1 * | 1/2007 | Pedersen | 381/191 |
| 2007/0047757 | A1 * | 3/2007 | Yang et al. | 381/423 |
| 2007/0140514 | A1 | 6/2007 | Pedersen | |
| 2007/0165902 | A1 * | 7/2007 | Matsumura et al. | 381/396 |
| 2007/0195976 | A1 * | 8/2007 | Sekino et al. | 381/191 |
| 2007/0201710 | A1 * | 8/2007 | Suzuki et al. | 381/174 |
| 2008/0013761 | A1 * | 1/2008 | Matsuzawa et al. | 381/191 |
| 2008/0123876 | A1 * | 5/2008 | Sato et al. | 381/174 |
| 2009/0066170 | A1 | 3/2009 | Abele | |
| 2009/0185700 | A1 * | 7/2009 | Suzuki | 381/174 |
| 2009/0226028 | A1 * | 9/2009 | Suganuma | 381/430 |
| 2009/0285417 | A1 * | 11/2009 | Shin et al. | 381/151 |
| 2010/0150381 | A1 * | 6/2010 | Lee et al. | 381/190 |
| 2010/0166242 | A1 | 7/2010 | Cohen et al. | |
| 2010/0176897 | A1 * | 7/2010 | Winkler et al. | 333/186 |
| 2011/0075867 | A1 * | 3/2011 | Chung et al. | 381/190 |
| 2011/0075879 | A1 * | 3/2011 | Kim et al. | 381/398 |
| 2012/0053393 | A1 * | 3/2012 | Kaltenbacher et al. | 600/25 |
| 2012/0308037 | A1 * | 12/2012 | Chen et al. | 381/92 |

* cited by examiner

ELECTROSTATIC LOUDSPEAKER WITH MEMBRANE PERFORMING OUT-OF-PLANE DISPLACEMENT

TECHNICAL FIELD

Embodiments of the present invention relate to an electrostatic loudspeaker. Some embodiments of the present invention relate to a method for operating an electrostatic loudspeaker. Some embodiments of the present invention relate to a method for manufacturing an electrostatic loudspeaker. In particular, the electrostatic loudspeaker may be a micro electrical mechanical system (MEMS) and the method for manufacturing the electrostatic loudspeaker may employ micro electrical mechanical system fabrication technology, more particularly planar micro electrical mechanical technology.

BACKGROUND

An electrostatic loudspeaker uses a loudspeaker design in which sound is generated by the force exerted on a membrane suspended in an electrostatic field. Macroscopic electrostatic loudspeakers typically use a thin flat diaphragm usually consisting of a plastic sheet coated with a conductive material such as graphite sandwiched between two electrically conductive grids, with a small air gap between the diaphragm and the grids. The diaphragm in an electrostatic loudspeaker is typically driven uniformly over its entire surface as the electrostatic force acting on the diaphragm is created by one or two stators (electrodes) which have approximately the same area and are arranged substantially parallel to the diaphragm. For this reason, there is no need for the diaphragm to be particularly rigid. This fact is exploited in some designs of electrostatic loudspeakers where the diaphragm is made as light as possible. Moreover, electrostatic loudspeakers may be operated in a pull-pull mode which typically reduces distortions. As a result, an electrostatic transducer can operate over an exceptionally wide frequency range without having to cross over to another driver. Another attribute of most electrostatic speakers is their naturally dipolar radiation pattern. A true dipole transducer radiates with equal intensity from the front and back of its diaphragm, but the outputs are in opposite phase. In combination with the relatively large size of a typical electrostatic panel, output at the sides tends to be very low relative to that of a conventional loudspeaker, which in turn minimizes side-wall reflections that tend to muddle sonic detail and stereo imaging.

Electrostatic loudspeakers may be designed as micro electrical mechanical systems (MEMS). MEMS are potentially small scaled—of the order of tens of micrometers—and their fabrication is compatible with semiconductor-like processes (e.g., CMOS (Complementary Metal Oxide Semiconductor). This leads to potentially large volume manufacture.

SUMMARY

Embodiments of the present invention provide an electrostatic loudspeaker comprising a membrane structure and an electrode structure. The membrane structure comprises a central membrane portion and a circumferential membrane portion. The electrode structure is configured to electrostatically interact with the membrane structure for causing a movement of the membrane structure along an axis of movement. The electrode structure comprises a circumferential electrode portion and an opening. The circumferential electrode portion is substantially aligned to the circumferential membrane portion and the opening is substantially aligned to the central membrane portion with respect to a direction parallel to the axis of movement. The central membrane portion is configured to extend at least partially through the opening when being in an end position of the movement of the membrane structure.

Further embodiments of the present invention provide an electrostatic loudspeaker comprising a membrane structure and an electrode structure. The membrane structure is configured for displacement along an axis of movement. The electrode structure is configured to electrostatically interact with the membrane structure for causing the displacement. A projection of the electrode structure on the membrane structure along the axis of the movement defines a first portion of the membrane structure. The membrane structure further comprises a second portion. The membrane structure is configured so that the second portion deflects, due to a kinetic energy caused by the movement, at an edge of the electrode structure during phase of the movement of the membrane structure. The second portion is configured to perform an out-of-plane displacement with respect to a plane defined by the electrode structure.

Further embodiments of the present invention provide a method for operating an electrostatic loudspeaker. The method comprises applying an electrical voltage between a first electrode at a membrane structure and a second electrode at an electrode structure. A projection of the electrode structure on the membrane structure along an axis of movement of the membrane structure defines a first membrane portion of the membrane structure. The membrane structure further comprises a second membrane portion. The method further comprises accelerating the membrane structure towards the electrode structure due to an electrostatic action between the first electrode and the second electrode, thereby increasing a kinetic energy of the membrane structure. The method also comprises causing the second membrane portion of the membrane structure to perform an out-of-plane displacement with respect to a plane defined by the electrode structure due to the kinetic energy while the first membrane portion remains at an originating side of the electrode structure.

Further embodiments of the present invention provide a method for manufacturing an electrostatic loudspeaker. The method comprises forming a membrane structure and forming an electrode structure. The membrane structure comprises a central membrane portion and a circumferential membrane portion. The central membrane portion is displaceable with respect to the circumferential membrane portion in a direction substantially orthogonal to an extension of the membrane structure. The electrode structure comprises a circumferential electrode portion and an opening. The circumferential electrode portion is substantially aligned to the circumferential membrane in a direction substantially orthogonal to an extension of the membrane structure and of the electrode structure. The opening is substantially aligned to the central membrane portion in the direction substantially orthogonal to the extension of the membrane structure and of the electrode structure so that the central membrane portion is configured to extend through the opening when being in an end position of a movement of the membrane structure while the circumferential membrane portion remains at one side of the electrode structure.

BRIEF DESCRIPTION OF THE DRAWINGS

Embodiments of the present invention are described herein, making reference to the appended drawings.

Figure 1A:
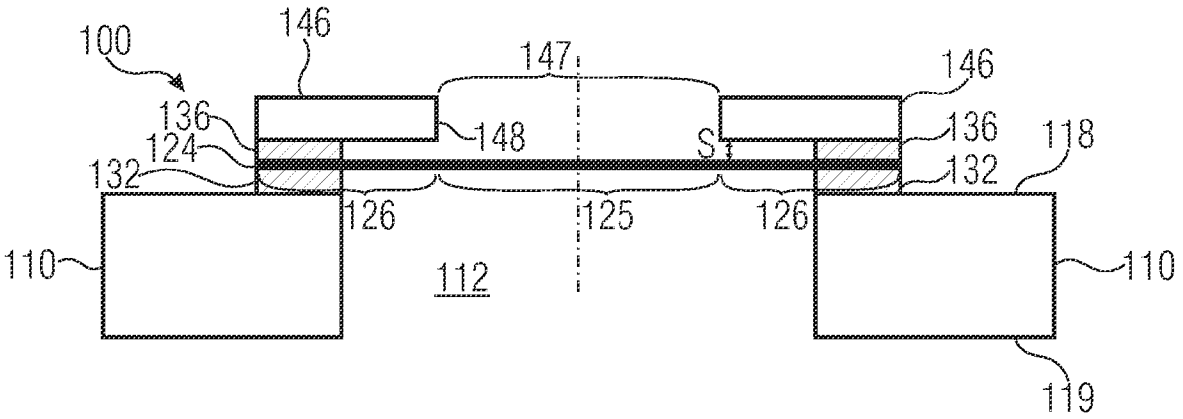
FIG. 1A shows a schematic cross section of an electrostatic loudspeaker according to an embodiment of teachings disclosed herein with a membrane structure being at a rest position.

Equal or equivalent elements or elements with equal or equivalent functionality are denoted in the following description by equal reference numerals or similar reference numerals. Furthermore, some functionally equal elements may also be provided with similar reference numbers wherein the two last digits are equal. Hence, descriptions provided for elements with the same reference numbers or with similar reference numbers are mutually exchangeable, unless noted otherwise.

DETAILED DESCRIPTION

In the following description, a plurality of details are set forth to provide a more thorough explanation of embodiments of the present invention. However, it will be apparent to one skilled in the art that embodiments of the present invention may be practiced without these specific details. In other instances, well known structures and devices are shown in schematic cross-sectional views or top-views rather than in detail in order to avoid obscuring embodiments of the present invention. In addition, features of the different embodiments described hereinafter may be combined with other features of other embodiments, unless specifically noted otherwise.

In order to satisfactorily fulfill its purpose, a loudspeaker typically has to provide large volume displacement to generate sufficient sound pressure level. Loudspeakers typically generate volume flow by displacement of a fluid, such as air. The displacement is obtained, in a large number of loudspeaker types, by a parallel movement relative to the sound propagation direction. This is true for many types of dynamic, piezoelectric, ferroelectric, or electrostatic loudspeakers in the macroscopic as well as in the microscopic implementation. Hence, large displacements are needed which is difficult on the microscopic level of implementation, especially. In particular, a large volume displacement out of a small area typically goes along with a need for a large out-of-plane displacement. Especially for micromechanically driven speakers this is in contrast to the microscopic nature of the fabricated devices, as vertical structure are typically only in the range of a few micrometers while a preferred displacement should be in a range from approximately 10 μm to approximately 100 μm. For example, the membrane of a MEMS transducer is typically manufactured using a sacrificial layer, for example silicon oxide ($SiO_2$). In use the amplitude of the membrane movement in some types of electrostatic loudspeakers is typically limited by approximately the thickness of the sacrificial layer because of structures formed on the sacrificial layers during the manufacturing process prior to (partly) removing the sacrificial layer, thus leaving the formed structures.

The teachings disclosed herein describe some options for generating a large out-of-plane displacement of a sound generating membrane that is fabricated by, for example, planar MEMS technologies with only small or typical error gap distances.

FIG. 1A shows a schematic cross section of an electrostatic loudspeaker 100 according to an embodiment of the teachings disclosed herein. The electrostatic loudspeaker 100 comprises a substrate 110 that functions as a support structure or a part of a support structure. The substrate 110 may comprise a semiconductor material, such as silicon. The substrate 110 comprises a first main surface 118 and a second main surface 119 that is substantially parallel to the first main surface 118. A cavity or trench 112 is formed in the substrate 110. The cavity 112 extends from the first main surface 118 to the second main surface 119 so that the cavity 112 is in fact a through hole. In alternative configurations the cavity 112 could be a blind hole extending from the first main surface 118. Furthermore, the cross section of the cavity 112 in a plane parallel to the first and second main surfaces 118, 119 is not necessarily uniform but could, for example, taper or widen up from the first main surface 118 to the second main surface 119.

A membrane structure 124 and an electrode structure 146 are arranged on the first main surface 118 of the substrate 110. A spacer 132 is interposed between the first main surface 118 and the membrane structure 124. The spacer 132 may provide an electrical isolation between the membrane structure 124 and the substrate 110. In some embodiments of the electrostatic loudspeaker 100 the membrane structure 124 may be arranged directly on the first main surface 118 of the substrate 110. In this case, an electrical isolation may be provided by isolating elements either within the membrane structure 124 or the substrate 110 or both.

The membrane structure 124 comprises a central membrane portion 125 and a circumferential membrane portion 126. Note that the electrostatic loudspeaker 100 is illustrated having a rotational symmetry in FIG. 1A so that the circumferential membrane portion 126 is substantially a ring and the central membrane portion 125 is substantially a circular disk. An outer part of the circumferential membrane portion 126 is attached to the spacer 132. The central membrane portion 125 and the circumferential membrane portion 126 may be structurally identical or similar, i.e., the distinction between the central membrane portion 125 and the circumferential membrane portion 126 may be due to different functions/behaviors of the central membrane portion and the circumferential membrane portion. Moreover, the membrane structure 124 may or may not comprise special transition structures at the border between the circumferential membrane portion 126 and the central membrane portion 125.

As an alternative to the rotational symmetry of the electrostatic loudspeaker 100 implied in FIG. 1A, the electrostatic loudspeaker could have an elliptical shape, a rectangular shape, a square shape, a hexagonal shape, or an octagonal shape, to name a few.

Figure 1B:
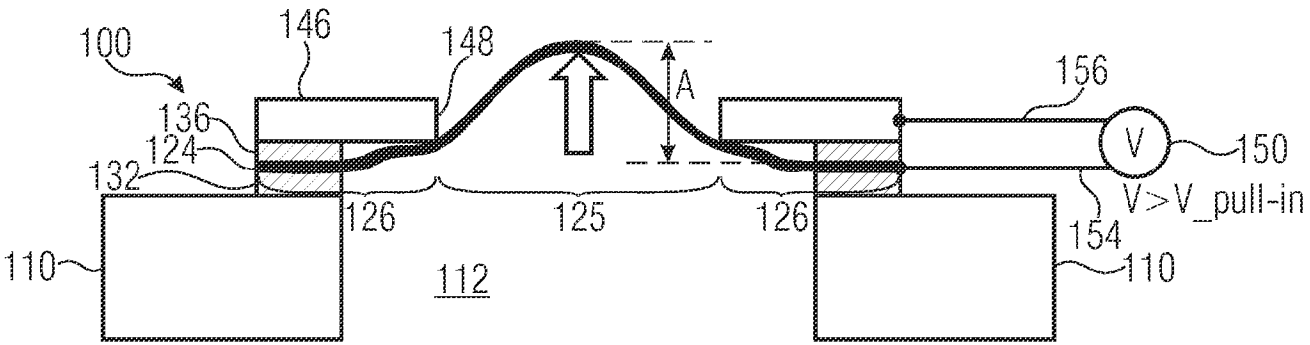
FIG. 1B shows a schematic cross section of the electrostatic loudspeaker from FIG. 1A with the membrane structure being in an end position of a displacement.

The electrode structure comprises a circumferential electrode portion 146 and an opening 147. The circumferential electrode portion 146 is substantially aligned to the circumferential membrane portion 126. The opening 147 is substantially aligned to the central membrane portion 125 with respect to a direction parallel to an axis of movement. The axis of movement of the membrane structure 124 is perpendicular to a main surface of the membrane structure 124. As can be seen in FIG. 1*b* the membrane structure 124 periodically moves towards the electrode structure during an operation of the electrostatic loudspeaker. The electrode structure 146 is arranged on a further spacer 136. The spacer 136 is arranged on a first main surface of the membrane structure 124. The spacer 136 may function as an electrical isolator between the membrane structure 124 and the electrode structure, in particular the circumferential electrode portion 146. The spacers 132 and the 136 are typically the residuals of earlier existing sacrificial layers that were removed during a manufacturing process of the electrostatic loudspeaker 100, especially in an extension of the cavity 112 along the axis of movement. The spacer 136 and the earlier sacrificial layer have a thickness s which also defines a spacing between the electrode structure and a rest position of the membrane structure 124. Sacrificial layers typically have a thickness of a few micrometers only. Thicker sacrificial layers tend to be relatively costly during manufacturing.

The circumferential electrode portion 146 of the electrode structure comprises an edge 148 that delimits the opening 147.

FIG. 1B shows the electrostatic loudspeaker 100 during operation and in particular when the membrane structure 124 is in an end position of its movement. In this situation the circumferential membrane portion 126 partially contacts the circumferential electrode portion 146 at the edge 148 and/or the vicinity thereof. The central membrane portion 125 extends through the opening 147. The movement or displacement of the membrane structure 124 is indicated in FIG. 1B by a thick arrow. In the end position illustrated in FIG. 1B the central membrane portion 125 is displaced by an amplitude A.

The movement of the membrane structure 124 is caused by creating an electrostatic force between the membrane structure 124 and the electrode structure. To this end, a voltage source 150 is electrically connected via a first connection 154 to the membrane structure 124 and via a second connection 156 to the circumferential electrode portion 146. When an electrical voltage is applied between the membrane structure 124 and the circumferential electrode structure 146, an attractive electrostatic force is created between these elements. As the circumferential electrode portion 146 is fixed to the spacer 136 and relatively rigid, the more flexible membrane structure 124 is deformed by the electrostatic force. A suspended part of the circumferential portion 126 accelerates and this acceleration is also transferred to the central membrane portion 125, due to a mechanical coupling between the circumferential membrane portion and the central membrane portion. In this manner, the central membrane portion 125 builds up kinetic energy during a first phase of the movement of the membrane structure. The first phase of the movement continues approximately until the circumferential membrane portion 126 contacts the circumferential electrode portion 146. During a second phase of the movement the central membrane portion 125 continues in the same direction as during the first phase which causes the central membrane portion to extend (at least partially) through the opening 147 of the electrode structure. In other words, the central membrane portion performs an out-of-plane displacement with respect to a plane defined by the electrode structure. With an increasing displacement from the rest position of the membrane structure, elastic forces increase within the membrane structure 124. The elastic forces oppose the movement caused by the kinetic energy. Accordingly, the central membrane portion 125 decelerates and eventually begins a returning movement towards the rest position once it has reached the end position which is depicted in FIG. 1B.

In FIG. 1B the end position amplitude A is illustrated as being substantially greater than the spacing between the electrode structure and the rest position of the membrane structure 124. In typical configurations of the electrostatic loudspeaker 100 the amplitude A of the central membrane portion 125 may be greater than the spacing s by at least 5% ($A \geq 1.05*s$), at least 10% ($A \geq 1.1*s$), at least 20% ($A \geq 1.2*s$), at least 50% ($A \geq 1.5*s$), at least 75% ($A \geq 1.75*s$), or at least 100% ($A \geq 2*s$).

The central membrane portion 125 may be configured to deflect when extending through the opening 147 as a result of the kinetic energy of the central membrane portion 125 due to the movement of the membrane structure 124.

As it is possible that the membrane structure 124 contacts the circumferential electrode portion 146, at least one of the membrane structure 124 and the circumferential electrode portion 146 may be electrically isolated to prevent an electrical short circuit. However, a mechanical contact between the membrane structure 124 and the circumferential electrode portion 146 is not absolutely necessary, and even in the end position of the membrane structure 124 a small gap or spacing may be maintained between the membrane structure 124 and the circumferential electrode portion 146. This may be achieved by controlling the voltage V provided by the voltage source 150 to be smaller than a pull-in voltage V_pull-in. When the voltage V is greater than the pull-in voltage V_pull-in, a mechanical contact occurs between the membrane structure 124 and the circumferential electrode portion 146, typically at or in the vicinity of the edge 148.

According to the teachings disclosed herein the membrane structure 124 is actuated on the outer portion of the membrane (ring) 126, for example by electrostatic pull-in. The inner portion 125 of the membrane structure 124 is accelerated by this actuation to stretch out of the actuation plane. The actuation plane is defined by a surface of the circumferential electrode portion 146 facing the membrane structure 124. The driving kinetic energy is defined by the membrane velocity (fast pull-in displacement) and the membrane's mass as well as an equivalent mass of accelerated air around the membrane.

The electrostatic loudspeaker 100 shown in FIGS. 1A and 1B and also other electrostatic loudspeakers according to the teachings disclosed herein may be used for digital sound reconstruction, in particular when it is operated at or close to a resonance frequency of the membrane structure 124.

In contrast to other designs of electrostatic loudspeakers the central membrane portion 125 can move freely not loosing energy against a limiting device such as a closed back plate functioning as a counter electrode. Nevertheless, the pull-in voltage V_pull-in on the ring portion 126 is still low enough to drive the electrostatic loudspeaker with reasonable voltages.

To summarize and according to at least one aspect of the teachings disclosed herein, a membrane is actuated in a small area only to drive the actuation of the full membrane to larger displacement in the free area utilizing its kinetic energy. One embodiment relates to a ring-actuated capacitive microspeaker.

Figure 2A:
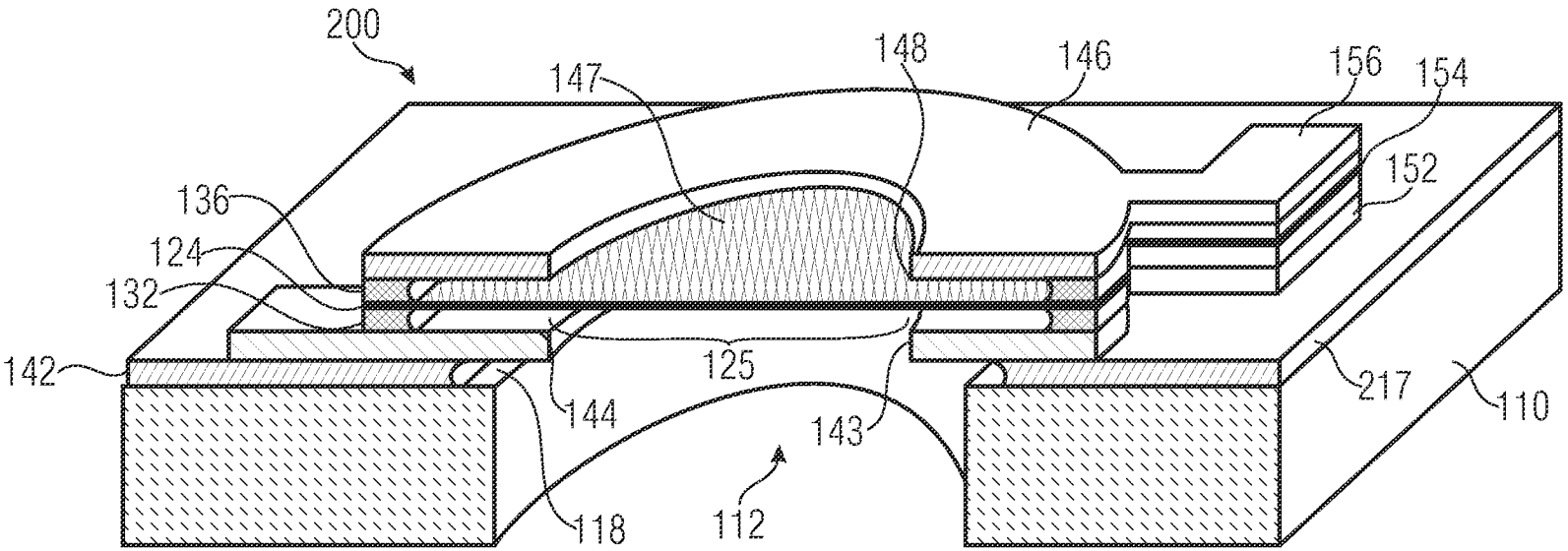
FIG. 2A shows a schematic, perspective cross section of an electrostatic speaker according to an embodiment of teachings disclosed herein with the membrane structure being at its rest position.
Figure 2B:
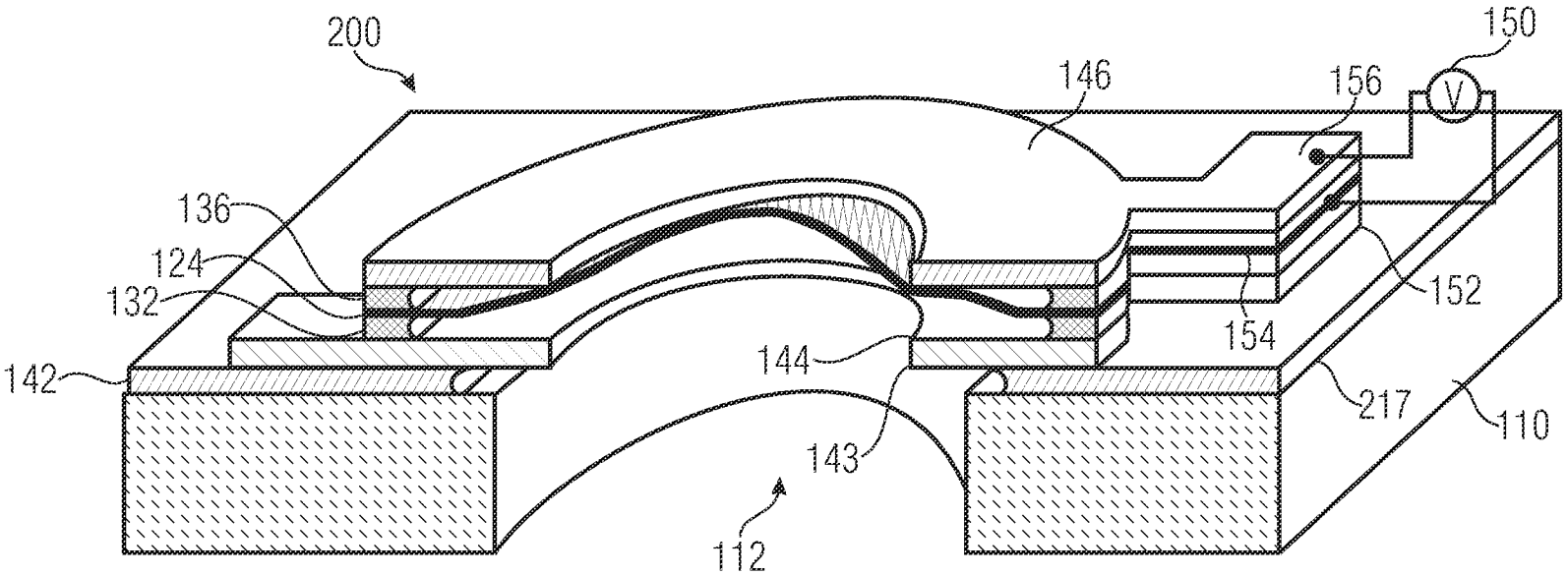
FIG. 2B shows a schematic, perspective cross section of the electrostatic loudspeaker from FIG. 2A with its membrane structure being in an end position of a displacement.

FIGS. 2A and 2B show perspective views of cross sections of an electrostatic loudspeaker 200 according to another embodiment of the teachings disclosed herein, namely an implementation in a parallel double back plate construction. The electrostatic loudspeaker 200 differs from the electrostatic loudspeaker 100 illustrated in FIGS. 1A and 1B in that it comprises a further electrode structure. The further electrode structure is arranged between the substrate 110 and the membrane structure 124 and comprises a circumferential electrode portion 142 and an opening 143. The opening 143 is delimited by an edge 144 of the further electrode structure. The spacer 132 is now interposed between the further electrode structure 142 and the membrane structure 124. The further electrode structure 142 is arranged on a main surface of an etch stop layer 217 or another auxiliary layer covering the first main surface 118 of the substrate 110. The etch stop layer 217 may be used to stop an etching step of a method for manufacturing the electrostatic loudspeaker 200, in particular an etching step that is used to form the cavity 112 in the substrate 110. Accordingly, the etch stop layer 217 comprises a different material than the substrate so that the cavity 112 may be selectively etched and the etch stop layer 217 is preserved until a subsequent selective etching step. The further electrode is connected to a voltage source via a further connection 152. As can be seen in FIG. 2*b*, the central membrane portion 125 of the membrane structure 124 bulges out of the opening 147 in the electrode structure when the membrane structure 124 is in an upper end position of its movement. In an analog manner, the membrane structure 124 may be brought in a lower end position in which the central membrane portion 125 bulges out of the further opening 143 of the further electrode structure. In the lower end position the membrane structure 124 bends at the edge 144 of the circumferential electrode portion 142.

The electrostatic loudspeaker 200 is, in principle, capable of doubling or even more than doubling an effect achieved by the electrostatic loudspeaker 100 shown in FIGS. 1A and 1B. This is particularly true if the electrostatic loudspeaker 200 is fabricated with an actuation ring above the upper surface of the membrane and an actuation ring below the lower surface of the membrane and when it is driven in a push-pull mode. The positional and directional terms "above", "upper", "below", and "lower" refer to the depiction of the electrostatic loudspeaker 200 in FIGS. 2A and 2B, and by no means to be understood as limiting. This is also true for other figures and their respective descriptions.

When the membrane structure 124 is to be accelerated towards the further electrode structure 142, the voltage source 150 is connected between the connection 154 and the connection 152 in order to apply the voltage V between the membrane structure 124 and the further electrode 142.

Figure 3:
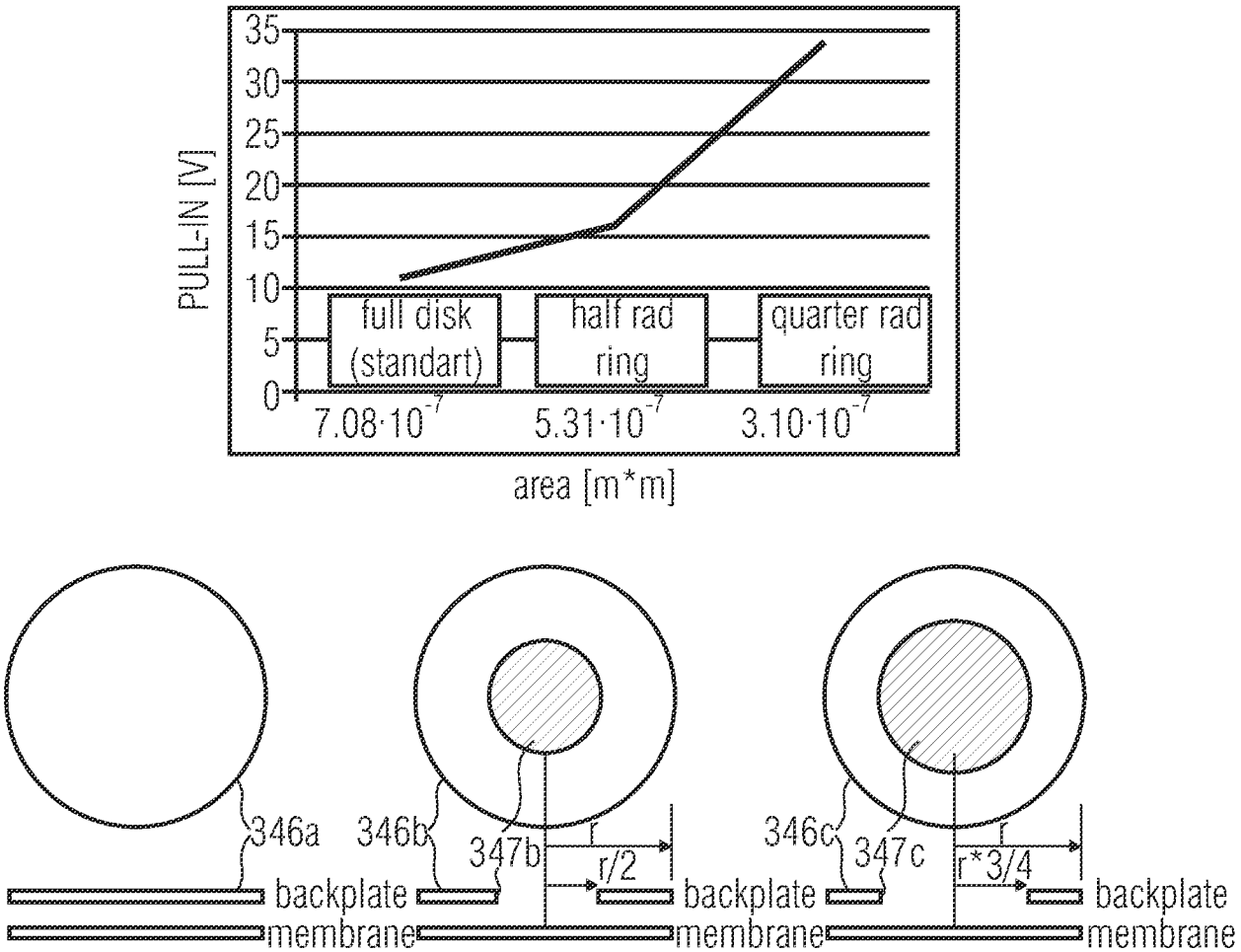
FIG. 3 illustrates a dependency of a required pull-in voltage on an effective electrode area.

FIG. 3 shows a result of a numerical simulation in the context of which the pull-in voltage V_pull-in has been determined in dependency on a ratio between the area of the circumferential electrode portion 146 and the total deflectable area of the membrane structure 124. In a first simulation the back plate or circumferential electrode 346*a* is in fact a full disc having a diameter of 1 mm and an area of approximately $7.08\times10^{-7}m^2$. With the full disc the pull-in voltage is approximately 11V.

In a second simulated case the circumferential electrode portion 346*b* has a width equal to half the radius r of the deflectable area of the membrane structure. This leaves an opening 347*b* having a radius r/2=0.0.25 mm that is also equal to half the radius r of the deflectable of the membrane structure. The ring-shaped circumferential electrode portion 346*b* has an area of approximately $5.31\times10^{-7}$ $m^2$. In this configuration a pull-in voltage V_pull-in of approximately 16V is required for causing a mechanical contact between the membrane structure and the electrode structure.

A third simulated case relates to a quarter radius ring in which the circumferential electrode portion 346*c* has a width equal to a quarter of the radius r of the deflectable area of the membrane portion. Accordingly, the opening 347*c* has a radius equal to 3/4r. The circumferential electrode portion 346*c* has an area of approximately $3.1\times10^{-7}m^2$ and the required pull-in voltage is approximately V=33V.

These simulation results show that pull-in is still possible with only a partial back plate or circumferential electrode portion. For the purposes of simulation a membrane having a diameter of 1 mm and a thickness of 330 nm has been assumed. A tensile stress within the membrane was assumed to be 43 MPa and an air gap between the membrane structure and the electrode structure was assumed to be 2 μm.

Figure 4:
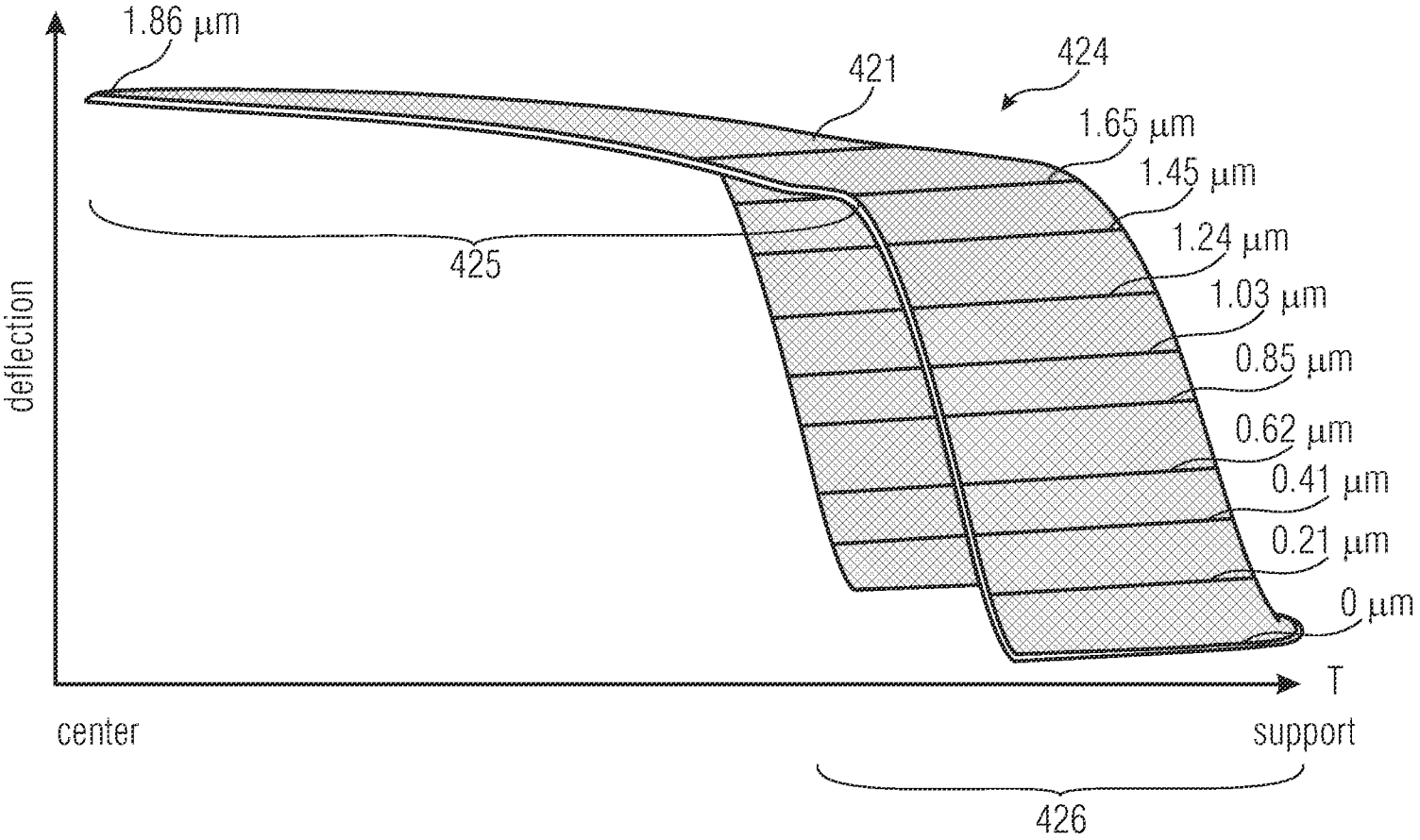
FIG. 4 shows perspective view of a cross section of a simulated membrane structure.

FIG. 4 shows perspective view of a cross section of a simulated membrane structure. In particular, FIG. 4 shows a segment of a circular membrane structure 424 comprising a circumferential membrane portion 426 and a central membrane portion 425. The abscissa of the graph in FIG. 4 represents a radius from a center of the circular membrane structure and the ordinate illustrates the deflection of the membrane structure 424. A mechanical contact between the membrane structure 424 and an electrode structure (not shown) occurs approximately at the location indicated by reference numeral 421. At this location, a limited pull-in occurs.

FIG. 4 illustrates one simulation result of several simulations using different input signals for driving the membrane structure 424. The input signal was a step function with different amplitudes for the different simulation cases. During a first simulation the amplitude of the input signal was approximately the pull-in voltage of the membrane structure and the electrode structure. In this case the membrane movement at the edge of the ring is limited to a displacement of 1.6 μm.

The result of a second simulation is illustrated in FIG. 4. The input signal was ramped up within 0.1 ms from 0V to 34V. A center deflection of more than 1.8 μm is achieved which translates to 0.2 μm additional displacement compared to the pull-in case.

In a third simulation, the result of which is not shown, an input signal is ramped up in 0.1 ms from 0V to 50V. A center deflection of 2.2 μm can be observed which is 0.6 μm additional displacement.

The resonance case was also simulated and it was shown that +/−5 μm displacement is possible with 100kHz actuation having a peak-to-peak swing of 34V. Accordingly, the electrostatic loudspeaker according to the teachings disclosed herein may be used for digital sound reconstruction in which the electrostatic loudspeaker is operated using a carrier signal of, for example, 100 kHz. In this mode of operation high acceleration of the membrane structure may be generated and thus relatively large additional displacements are possible. Driving the electrostatic loudspeaker in self resonance may further increase the amplitude (for simulation purposes, air damping needs to be taken into account).

Figure 5A:
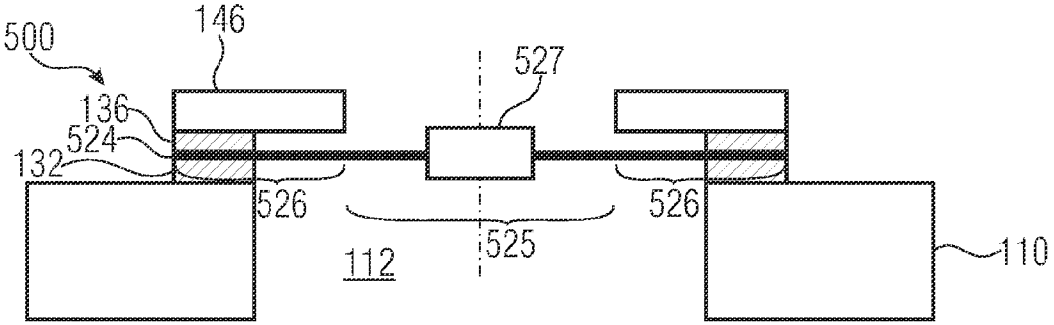
FIGS. 5A and 5B show schematic cross sections through an electrostatic loudspeaker according to an embodiment of the teachings disclosed herein having an additional mass at a central membrane portion at a rest position and an end position, respectively.
Figure 5B:
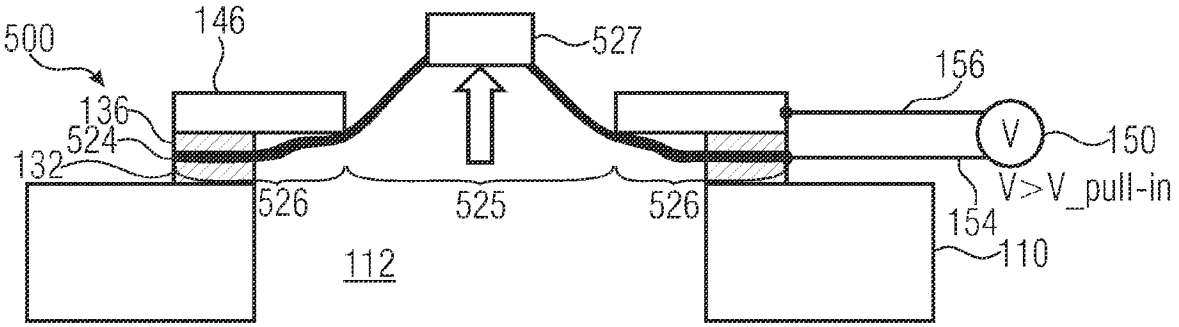

FIGS. 5A and 5B show schematic cross sections of an electrostatic loudspeaker 500 according to the teachings disclosed herein with the membrane structure 524 being at a rest position (FIG. 5A) and in an end position (FIG. 5B). The membrane structure 524 comprises an additional mass 527 on the central membrane portion 525. The additional mass 527 increases the kinetic energy of the membrane structure 524 while the membrane structure 524 moves from the rest position towards the end position illustrated in FIG. 5B. When the circumferential membrane portion 526 mechanically contacts or abuts at the circumferential electrode portions 146, the increased kinetic energy of the central membrane portion 525 including the additional mass 527 causes an increase in the maximal displacement which in turn results in higher sound pressure levels. With the additional mass 527 the central membrane portion 525 has a higher mass-to-area ratio than the circumferential membrane portion 526. The high mass-to-area ratio of the central membrane portion 525 may also be achieved with other measures, such as gradually increasing a thickness of the membrane structure 524 from the circumferential membrane portion 526 to the central membrane portion 525.

Figure 6:
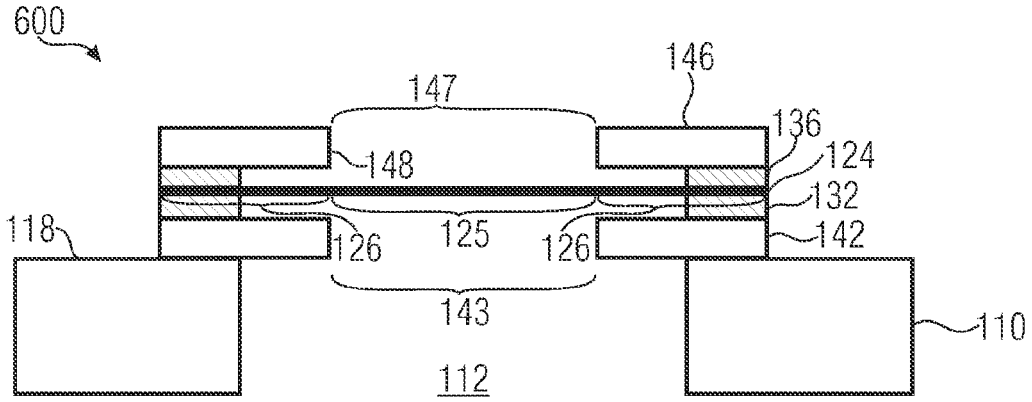
FIG. 6 shows a schematic cross section of an electrostatic loudspeaker according to an embodiment of the teachings disclosed herein having a double back plate configuration.

FIG. 6 shows a schematic cross section of an electrostatic loudspeaker 600 according to a further embodiment of the teachings disclosed herein. The electrostatic loudspeaker 600 is similar to the electrostatic loudspeaker 200 from FIGS. 2A and 2B. The electrostatic loudspeaker 600 comprises a double back plate. The (upper) electrode structure with the circumferential electrode portion 146 and the opening 147 is a part of the double back plate structure. The (lower) electrode structure with the circumferential electrode portion 142 and the opening 143 is a part of the double back plate structure, too. As a difference to the electrostatic loudspeaker 200 shown in FIGS. 2A and 2B, the circumferential electrode portion 142 is arranged directly on the first main surface 118 of the substrate 110, whereas in the electrostatic loudspeaker 200 these two elements were separated by the etch stop layer 217.

To summarize, the electrostatic loudspeaker 600 shown in FIG. 6 comprises a further electrode structure 142, 143 which is arranged at an opposite side of the membrane structure 124 than the (upper) electrode structure. The further electrode structure comprises a further opening 143 and a further circumferential electrode portion 142. The central membrane portion 125 is configured to extend through the further opening 143 at least partially when being in a further end position of the movement of the membrane structure 124.

Figure 7:
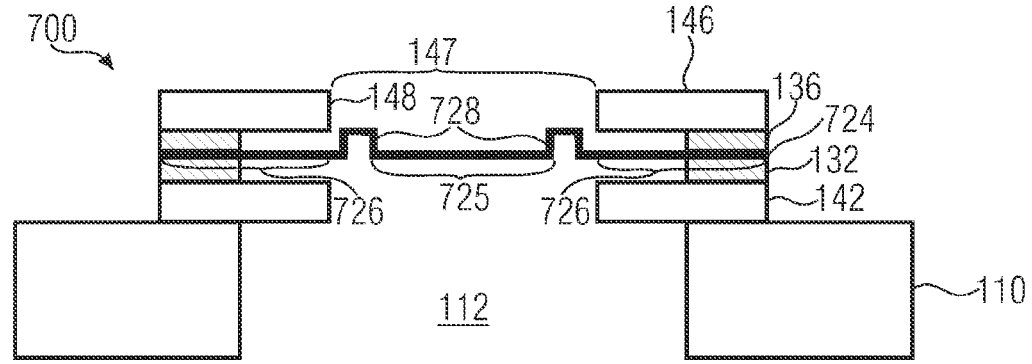
FIG. 7 shows a schematic cross section of an electrostatic loudspeaker according to an embodiment of the teachings disclosed herein having membrane corrugations.

FIG. 7 shows a schematic cross section of an electrostatic loudspeaker 700 according to a further embodiment of the teachings disclosed herein. With the exception of the membrane structure 724 the electrostatic loudspeaker 700 is similar to the electrostatic loudspeaker 600 shown in FIG. 6. The membrane structure 724 comprises a circumferential membrane portion and a central membrane portion 725. The membrane structure 724 further comprises corrugations 728 which are arranged between (at a transition of) the central membrane portion 725 and the circumferential membrane portion 726. The corrugation 728 may be ring-shaped and provide a flexion structure between the central membrane portion 725 and the circumferential membrane portion 726. Such a flexion structure could comprise several corrugations or other elements such as hinges. The corrugation 728 facilitates a bending of the membrane structure 724 at the transition from the circumferential membrane portion 726 to the central membrane portion 725. An out-of-plane displacement of the central membrane portion 725 may thus be increased so that the central membrane portion 725 may extend still further through opening 147 of the circumferential membrane portion 146.

Figure 8A:
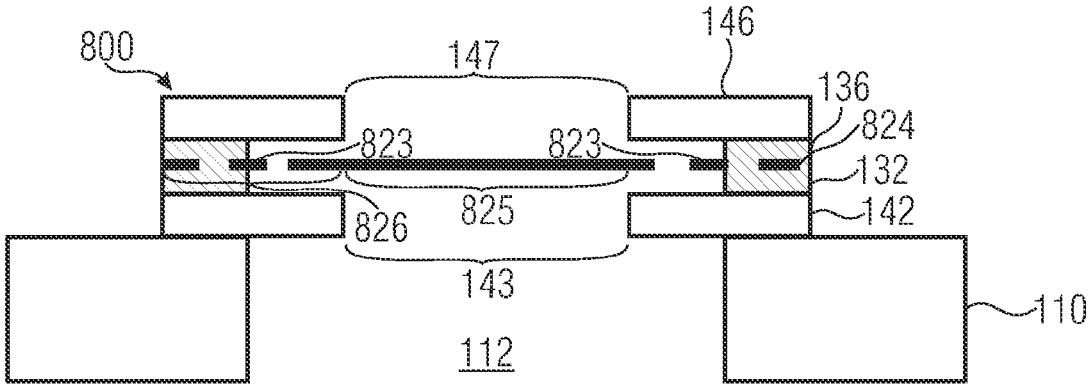
FIGS. 8A and 8B show a schematic cross section and a schematic top view, respectively, of an electrostatic loudspeaker according to an embodiment of the teachings disclosed herein having a hinge supported membrane structure.
Figure 8B:
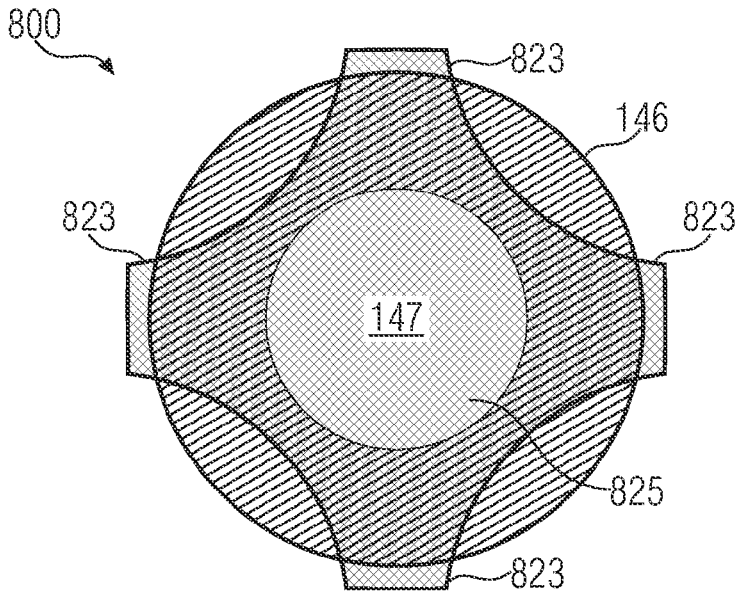

FIGS. 8A and 8B show a schematic cross section and a schematic top view of an electrostatic loudspeaker 800 according to a further embodiment of the teachings disclosed herein. The electrostatic loudspeaker 800 comprises a membrane structure 824 that is hinge supported. The membrane structure 824 comprises hinges 823 which are schematically illustrated in the schematic cross section of FIG. 8A and more clearly visible in the schematic top view of FIG. 8B. In particular, four hinges 823 mechanically connect a deflectable or displaceable area of the membrane with the spacers 132 and 136, which in turn are fixedly attached to the substrate 110 via the (lower) circumferential electrode portion 142. As the hinges 823 are relatively narrow, the membrane structure 824 may easily bend in these regions. The hinges 823 are part of the circumferential membrane portion 826. The central membrane portion 825 may extend through the opening 147 in the electrode structure when the membrane structure 824 is in (or near) the upper end position of the membrane structure movement. In an analog manner the central membrane portion 825 may extend through the opening 143 (at least partially) when the membrane structure 824 is at or near the (lower) end position of the membrane structure movement. The hinges 823 produce a weaker restoring force when the membrane structure 824 is displaced due to the electrostatic force exerted by the electrode structures 146, 142 than in a configuration in which the membrane structure 824 is mechanically connected to the spacers 832, 836 (more or less) at its entire circumference. Therefore, the membrane structure 824 may experience a stronger acceleration in the electrostatic loudspeaker 800 than in, for example, the electrostatic loudspeaker 600 shown in FIG. 6. An increase in the acceleration of the membrane structure 824 causes an increase of the kinetic energy of the central membrane portion 825 at an instant of the membrane structure movement when the mechanical contact between the circumferential membrane portion 826 and the circumferential electrode portion 146 or 142 occurs. This increased kinetic energy causes an increased maximal displacement of the central membrane portion 825 in the end position of the membrane structure movement.

Figure 9A:
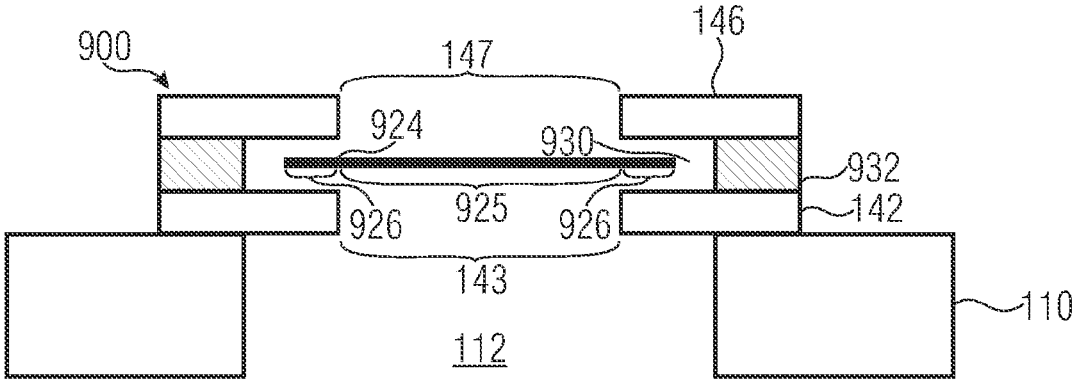
FIGS. 9A and 9B show a schematic cross section and a schematic top view, respectively, of an electrostatic loudspeaker according to an embodiment of the teachings disclosed herein having a floating membrane structure.
Figure 9B:
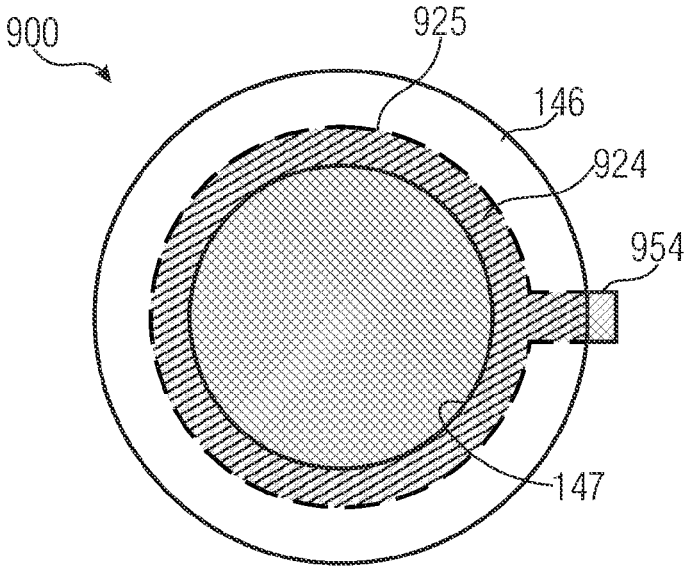

FIGS. 9A and 9B show a schematic cross section and a schematic top view, respectively, of an electrostatic loudspeaker 900 according to a further embodiment of the teachings disclosed herein. The electrostatic loudspeaker 900 comprises a floating membrane structure 924. The floating membrane structure 924 comprises a circumferential membrane portion 926 and a central membrane portion 925. The floating membrane 924 is not specifically mechanically connected to the surrounding structures, such as the spacer 932 or the circumferential electrode portions 142, 146. Instead, the floating membrane structure 924 is arranged within a gap 930 delimited by the (lower) circumferential electrode portion 142, the (upper) circumferential portion 146, and the spacer 932. The floating membrane structure 924 may move more or less freely within the gap 930, but it cannot leave the gap 930, because it is larger than the openings 147 and 143. During an operation of the electrostatic loudspeaker 900 the circumferential portion 926 may get in mechanical contact with or abut at the circumferential electrode portions 142, 146. While the movement of the circumferential membrane portion 926 is stopped by this mechanical contact, the central membrane portion 925 may continue its movement until it reaches one of the two end positions. Accordingly, the central membrane portion 925 may extend at least partially through the openings 143 and 147 during some phases of the movement and/or perform an out-of-plane displacement.

For the generation of a significant electrostatic force the floating membrane structure 924 needs to be electrically charged. This may be achieved by implanting electrical charges into the floating membrane structure during a manufacture of the electrostatic loudspeaker 900. These implanted electrical charges are typically well isolated in order to prevent a withdrawal of the electrical charges and to achieve a good long time stability. Another option for electrically charging the membrane structure 924 is shown in FIG. 9B, in which the membrane structure 924 comprises an electrical connection 954. The electrical 954 is highly flexible so that the membrane structure 924 can still be regarded as a floating membrane structure.

Figure 10A:
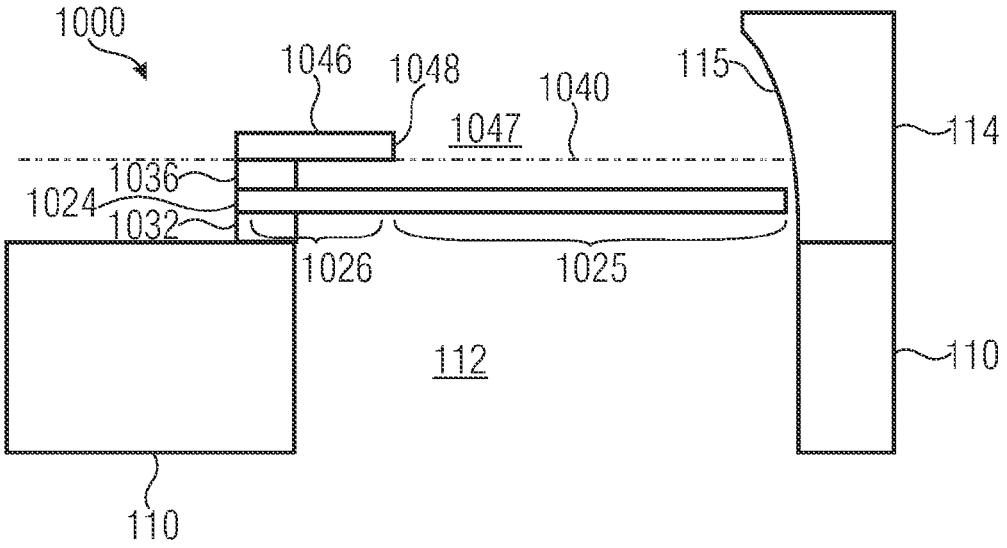
FIGS. 10A and 10B show schematic cross sections of an electrostatic loudspeaker according to a further embodiment of the teachings disclosed herein at a rest position and an end position of the membrane structure, respectively.
Figure 10B:
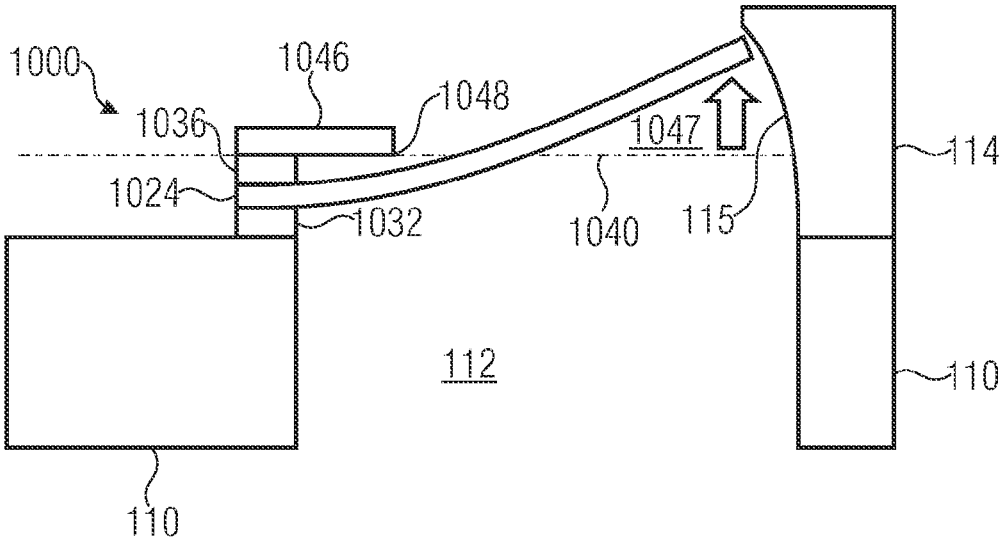

FIGS. 10A and 10B show schematic cross sections of an electrostatic loudspeaker 1000 at a rest position and an end position of its membrane structure 1024. The membrane structure 1024 is configured for a displacement along an axis of movement indicated by the arrow in FIG. 10B. The electrostatic loudspeaker 1000 further comprises an electrode structure 1046 configured to electrostatically interact with the membrane structure 1024 for causing the displacement. A projection of the electrode structure 1046 on the membrane structure 1024 along the axis of movement defines a first portion 1026 of the membrane structure 1024. The membrane structure 1024 further comprises a second portion 1025.

The electrostatic loudspeaker 1000 has an opening 1047 which is delimited by the electrode structure 1046 at one side. At another side, the opening 1047 is delimited by a wall 114 which is arranged on the first main surface 118 of the substrate 110. The membrane structure 1024 is configured so that the second portion 1025 deflects, due to a kinetic energy caused by the movement, at an edge 1048 of the electrode structure during a phase of the movement of the membrane structure 1024. Accordingly, the second portion 1025 is configured to perform an out-of-plane displacement with respect to a plane 1040 defined by the electrode structure 1046.

The wall 114 may comprise a curved surface 115 facing the electrode structure 1046 so that an excessive leakage of air (or fluid) moved by the membrane structure 1024 around an end of the second portion 1025 is prevented.

The projection of the electrode structure 1046 on the membrane structure 1024 to define the first portion of the membrane structure is typically done in a direction perpendicular to the plane 1040. Accordingly, the projection is performed along an axis of movement during an initial phase of the membrane structure movement, i.e. when the membrane structure 1024 is at or close to the rest position. In the alternative, the projection could be defined by observing at which location of the membrane structure 1024 a contact with the edge 1048 is first established during the movement of the membrane structure 1024.

The first portion 1026 corresponds to the circumferential membrane portion of the electrostatic loudspeakers 100, 200, 500, 600, 700, 800, 900 described above. The second membrane portion 1025 corresponds to the central membrane portion of the electrostatic loudspeakers 100, 200, 500, 600, 700, 800, 900 described above. The edge 1048 of the electrode structure 1046 delimits the opening 1047 within the electrode structure 1046 so that the second membrane portion 1025 is configured to extend, when being in an end position of the movement, through the opening 1047 while the first membrane portion 1026 remains at an originating site of the electrode structure 1046. The originating side of the electrode structure 1046 is the side at which the membrane structure 1024 is located.

The electrostatic loudspeaker according to the teachings disclosed herein may be a micro electrical mechanical system (MEMS). Furthermore, the micro electrical mechanical system may be based on planar micro electrical mechanical system technology. The electrostatic loudspeaker may be a digital loudspeaker.

The membrane structure may comprise a corrugation. The membrane structure may be configured to be driven in a resonance mode or a self-resonance mode. In addition or in the alternative, the circumferential membrane portion may be configured to temporarily abut at the circumferential electrode portion during the movement of the membrane structure.

Figure 11:
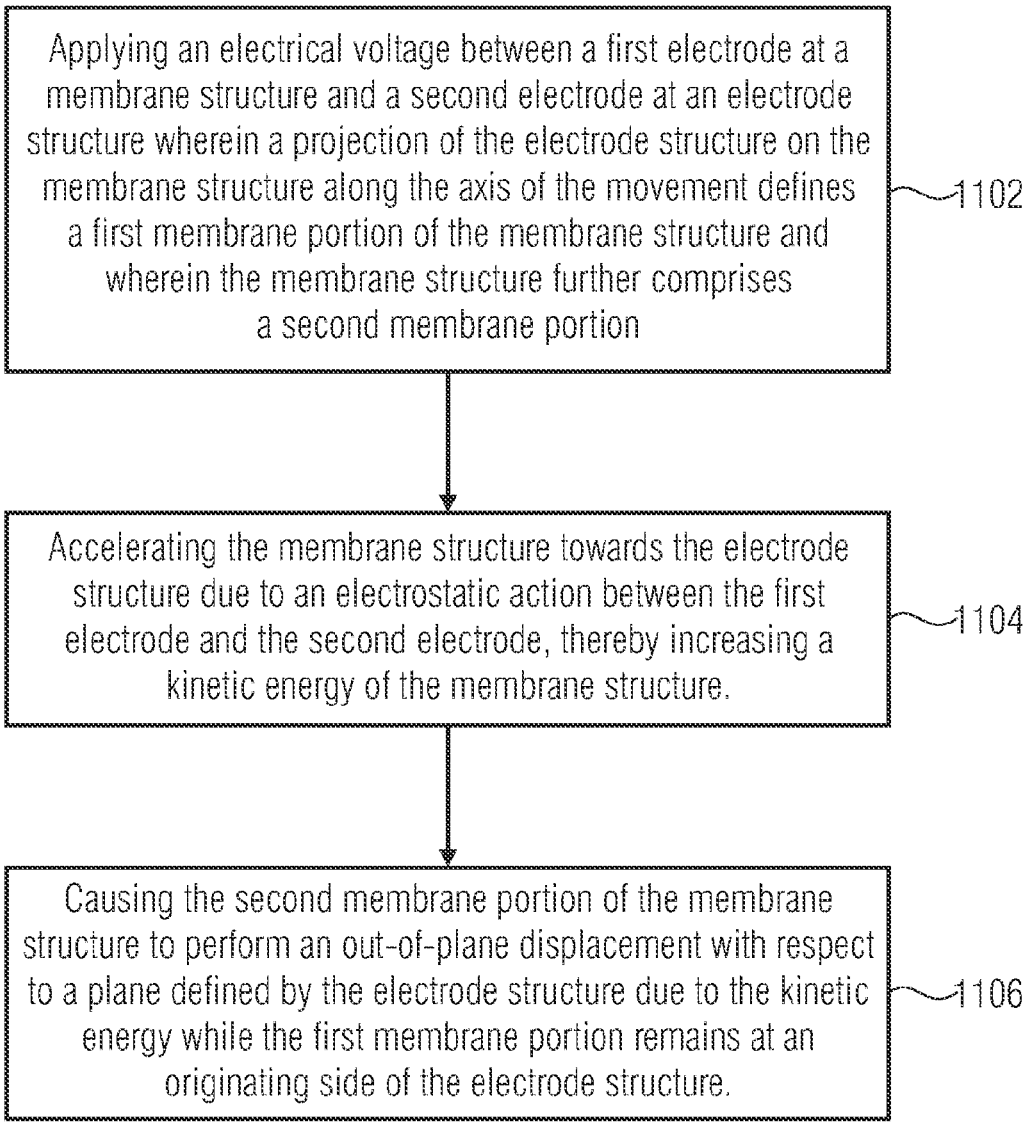
FIG. 11 shows a schematic flow diagram of a method for operating an electrostatic loudspeaker according to teachings disclosed herein.

FIG. 11 shows a schematic flow diagram of a method for operating an electrostatic loudspeaker. The method comprises a step 1102 of applying an electrical voltage between a first electrode at a membrane structure and a second electrode at an electrode structure, wherein a projection of the electrode structure on the membrane structure along an axis of a movement of the membrane structure defines a first membrane portion of the membrane structure and wherein the membrane structure further comprises a second membrane portion. This means that the electrode structure is in the way of the first membrane portion when the membrane structure performs the movement. However, the movement of the second membrane portion is not blocked by the electrode structure.

During a method step 1104 the membrane structure is accelerated towards the electrode structure due to an electrostatic action between the first electrode and the second electrode. The acceleration of the membrane structure increases a kinetic energy of the membrane structure. The electrostatic action occurs mainly between the first membrane portion and the electrode structure. An electrostatic action between the second membrane portion and the electrode structure is typically weaker. Nevertheless, configurations of the electrostatic loudspeaker according to the teachings disclosed herein are imaginable in which the electrostatic action between the second membrane portion and the electrode structure is approximately as strong as the electrostatic action between the first membrane portion and the electrode structure, or even stronger. In any event, the second membrane portion is also accelerated as it is mechanically coupled to the first membrane portion.

At a step 1106 the second membrane portion is caused to perform an out-of-plane displacement with respect to a plane defined by the electrode structure. The out-of-plane displacement is due to the kinetic energy built up during the acceleration of step 1104. Meanwhile, the first membrane portion remains at an originating site of the electrode structure, as its movement is blocked by the electrode structure.

In the following, a number of possible configurations, implementations, further specifications and features of the method for operating an electrostatic loudspeaker are discussed. The second membrane portion may deflect while going beyond the plane defined by the electrode structure, i.e. while performing the out-of-plane displacement with respect to the plane defined by the electrode structure.

The first membrane portion may be a circumferential membrane portion and the second membrane portion may be a central membrane portion of the membrane structure. The edge of the electrode structure may delimit an opening within the electrode so that the second membrane portion extends, when being in an end position of the movement, through the opening while the first membrane portion remains at an originating side of the electrode structure.

The electrostatic loudspeaker may be a micro electrical mechanical system (MEMS).

The method for operating the electrostatic loudspeaker may further comprise one or more of the following steps. An electrical voltage may be applied between the first electrode and a third electrode at a further electrode structure arranged at an opposite side of the membrane structure than the (above mentioned) electrode structure. The membrane structure may be accelerated towards the further electrode structure due to an electrostatic action between the first electrode and the third electrode. As a consequence, the kinetic energy of the membrane structure is increased. The second membrane portion may be caused to go beyond a further plane defined by the further electrode structure due to the kinetic energy while the first membrane portion remains at a side of a rest position of a further electrode structure (originating side). In other words, the second membrane portion may be caused to perform a further out-of-plane displacement with respect to the further plane defined by the further electrode structure.

Figure 12:
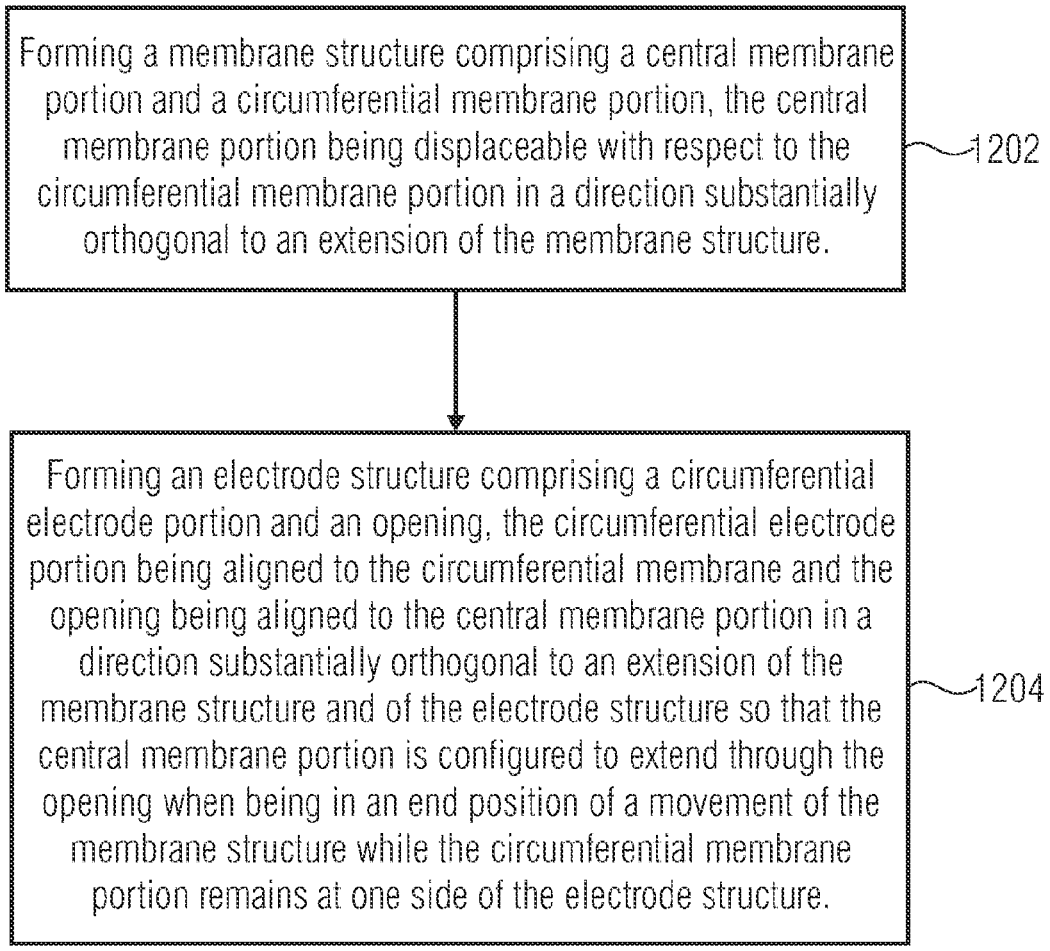
FIG. 12 shows a schematic flow diagram of a method for manufacturing an electrostatic loudspeaker according to teachings disclosed herein.

FIG. 12 shows a schematic flow diagram of a method for manufacturing an electrostatic loudspeaker. The method for manufacturing an electrostatic loudspeaker comprises a step 1202 of forming a membrane structure and a step 1204 of forming an electrode structure. The membrane structure comprises a central membrane portion and a circumferential membrane portion. The central membrane portion is displaceable with respect to the circumferential membrane portion in a direction substantially orthogonal to an extension of the membrane structure. When the method for manufacturing an electrostatic loudspeaker is directed at the electrostatic loudspeaker 1000 illustrated in FIGS. 10A and 10B, the membrane structure comprises a first membrane portion and a second membrane portion which are defined by a projection of the electrode structure on the membrane structure along a direction of a movement of the membrane structure during operation of the electrostatic loudspeaker 1000. Indeed, these definitions of the first and second membrane portions are also applicable to most of the other embodiments illustrated and discussed herein. The central membrane portion (second membrane portion) is displaceable with respect to the circumferential membrane portion (first membrane portion) in a direction substantially orthogonal to an extension of the membrane structure.

The electrode structure comprises a circumferential electrode portion and an opening. The circumferential electrode portion is substantially aligned to the circumferential membrane portion and the opening is substantially aligned to the central membrane portion in a direction substantially orthogonal to an extension of the membrane structure and of the electrode structure. Accordingly, the central membrane portion is configured to extend through the opening when being in an end position of a movement of the membrane structure while the circumferential membrane portion remains at one side of the electrode structure, i.e. the originating side.

In further embodiments of the method for manufacturing an electrostatic loudspeaker the central membrane portion may be formed to be deflectable with respect to the circumferential membrane portion in the direction substantially orthogonal to the extension of the membrane structure. The circumferential membrane portion may be formed as a substantially ring-shaped portion. The central membrane portion may be formed to have a higher mass-to-area ratio than the circumferential membrane portion.

The method for manufacturing an electrostatic loudspeaker may employ micro electrical mechanical system fabrication technology or planar micro electrical mechanical system fabrication technology.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

The invention claimed is:

1. An electrostatic loudspeaker comprising:

a membrane structure comprising a central membrane portion and a circumferential membrane portion;

an electrode structure configured to electrostatically interact with the membrane structure for causing a movement of the membrane structure along an axis of movement, the electrode structure comprising a circumferential electrode portion and an opening, the circumferential electrode portion being substantially aligned to the circumferential membrane portion and the opening being substantially aligned to the central membrane portion with respect to a direction parallel to the axis of movement; and a gap between the membrane structure and the electrode structure, wherein, in an end position of the movement of the membrane structure, the central membrane portion is configured to extend at least partially through the opening, and wherein an amplitude of the central membrane portion is greater than a thickness of the gap by at least 5%.

2. The electrostatic loudspeaker according to claim 1, wherein the central membrane portion is configured to deflect when extending through the opening as a result of a kinetic energy of the central membrane portion due to the movement of the membrane structure.

3. The electrostatic loudspeaker according to claim 1, wherein the circumferential electrode portion is substantially ring-shaped.

4. The electrostatic loudspeaker according to claim 1, wherein the central membrane portion has a higher mass-to-area ratio than the circumferential membrane portion.

5. The electrostatic loudspeaker according to claim 1, wherein the membrane structure comprises a flexion structure between the central membrane portion and the circumferential membrane portion.

6. The electrostatic loudspeaker according to claim 1, wherein the electrostatic loudspeaker is a micro electrical mechanical system.

7. The electrostatic loudspeaker according to claim 6, wherein the micro electrical mechanical system is based on planar micro electrical mechanical system technology.

8. The electrostatic loudspeaker according to claim 1, further comprising a further electrode structure arranged at an opposite side of the membrane structure than the electrode structure and comprising a further opening and a further circumferential electrode portion, wherein the central membrane portion is further configured to extend through the further opening at least partially when being in a further end position of the movement of the membrane structure.

9. The electrostatic loudspeaker according to claim 1, wherein the electrostatic loudspeaker is a digital loudspeaker.

10. The electrostatic loudspeaker according to claim 1, wherein the membrane structure comprises a corrugation.

11. The electrostatic loudspeaker according to claim 1, wherein the membrane structure is hinge supported at a support structure.

12. The electrostatic loudspeaker according to claim 1, wherein the membrane structure comprises a floating membrane.

13. The electrostatic loudspeaker according to claim 1, wherein the membrane structure is configured to be driven in a resonance mode.

14. The electrostatic loudspeaker according to claim 1, wherein the circumferential membrane portion is configured to temporarily abut at the circumferential electrode portion during the movement of the membrane structure.

15. An electrostatic loudspeaker comprising:

a membrane structure configured for displacement along an axis of movement;

an electrode structure configured to electrostatically interact with the membrane structure for causing movement of the membrane structure, wherein the electrode structure comprises an edge so that a projection of the electrode structure on the membrane structure along the axis of the movement defines a first membrane portion of the membrane structure and wherein the membrane structure further comprises a second membrane portion; and a gap between the membrane structure and the electrode structure, wherein the membrane structure is configured so that the second membrane portion deflects, due to a kinetic energy caused by the movement of the membrane structure so that the second membrane portion extends at least partially beyond a plane defined by a surface of the electrode structure facing away from the membrane structure.

16. The electrostatic loudspeaker according to claim 15, wherein the first membrane portion is a circumferential membrane portion and the second membrane portion is a central membrane portion, and wherein the edge of the electrode structure delimits an opening within the electrode structure so that the second membrane portion is configured to extend, when being in an end position of the movement, through the opening while the first membrane portion remains at an originating side of the electrode structure.

17. A method for operating an electrostatic loudspeaker, the method comprising:

applying an electrical voltage between a first electrode at a membrane structure and a second electrode at an electrode structure wherein a projection of the electrode structure on the membrane structure along an axis of a movement of the membrane structure defines a first membrane portion of the membrane structure and wherein the membrane structure further comprises a second membrane portion;

accelerating the membrane structure along the axis of the movement towards the electrode structure due to an electrostatic action between the first electrode and the second electrode such that the membrane structure extends across a gap between the membrane structure and the electrode structure, thereby increasing a kinetic energy of the membrane structure; and causing the second membrane portion of the membrane structure to perform an out-of-plane displacement so that the second membrane portion extends at least partially beyond a plane defined by a surface of the electrode structure facing away from the membrane structure due to the kinetic energy while the first membrane portion remains at an originating side of the electrode structure.

18. The method according to claim 17, wherein the second membrane portion deflects while performing the out-of-plane displacement with respect to the plane defined by the electrode structure.

19. The method according to claim 17, wherein the first membrane portion is a circumferential membrane portion and the second membrane portion is a central membrane portion, and wherein an edge of the electrode structure delimits an opening within the electrode structure so that the second membrane portion extends, when being in an end position of the movement, through the opening while the first membrane portion remains at an originating side of the electrode structure.

20. The method according to claim 17, wherein the electrostatic loudspeaker is a micro electrical mechanical system.

21. The method according to claim 17, further comprising:

applying an electric voltage between the first electrode and a third electrode at a further electrode structure arranged at an opposite side of the membrane structure than the electrode structure;

accelerating the membrane structure towards the further electrode structure due to an electrostatic action between the first electrode and the third electrode, thereby increasing the kinetic energy of the membrane structure; and causing the second membrane portion to go beyond a further plane defined by the further electrode structure due to the kinetic energy while the first membrane portion remains at a side of a rest position of the further electrode structure.

22. The method according to claim 17, further comprising deflecting the second membrane portion with respect to the first membrane portion in a direction substantially orthogonal to an extension of the membrane structure.

23. The method according to claim 17, wherein the electrode structure is formed as a substantially ring-shaped portion.

24. The method according to claim 17, wherein the second membrane portion is formed to have a higher mass-to-area ratio than the first membrane portion.

25. An electrostatic loudspeaker comprising:

a membrane structure comprising a central membrane portion and a circumferential membrane portion;

an electrode structure configured to electrostatically interact with the membrane structure by causing a movement of the membrane structure along an axis of movement, the electrode structure comprising a circumferential electrode portion that defines an opening; and a gap between the membrane structure and the electrode structure, wherein the central membrane portion is configured to extend at least partially through the opening when in an end position of the movement of the membrane structure, and to perform an out-of-plane displacement, in which the central membrane portion extends at least partially beyond a plane defined by a surface of the electrode structure facing away from the membrane structure.

* * * * *